United States Patent [19]

Schosek

[11] 4,251,058

[45] Feb. 17, 1981

[54] DRIVE JAWS FOR AN UNDERGROUND PIPE INSTALLER DEVICE

[76] Inventor: William O. Schosek, 7942 Marx Dr., North Fort Myers, Fla. 33903

[21] Appl. No.: 68,150

[22] Filed: Aug. 20, 1979

Related U.S. Application Data

[63] Continuation-in-part of Ser. No. 951,626, Oct. 16, 1978.

[51] Int. Cl.[3] ..... E21B 19/00

[52] U.S. Cl. ..... 254/29 R

[58] Field of Search ..... 254/29 R, 30, 31

[56] References Cited

U.S. PATENT DOCUMENTS

| | | | |
|---|---|---|---|
| 3,645,502 | 2/1972 | Stromp | 254/29 R |
| 3,988,004 | 10/1976 | Schosek | 254/29 R |

*Primary Examiner*—Robert C. Watson

*Attorney, Agent, or Firm*—Alfred E. Wilson

[57] ABSTRACT

Drive jaws for a device of the type used to install an underground pipe, service line, etc. between two given points, such as the opposed sides of a finished driveway or street, for example. The drive jaws preferably include a pair of spaced apart plates with aligned through holes sized for free passage therethrough of a rod used in the formation of a hole for the pipe or other conduit. A pair of axially aligned laterally extending pivot pins are provided on respective side edges of each jaw with the axes thereof lying in a horizontal plane in a transverse relation through the common axis of the through holes; and including bronze bearing blocks on each side of the jaws to rotatably journal the pivot pins and for sliding engagement in slots provided in opposed side walls of the pipe installer device.

9 Claims, 4 Drawing Figures

DRIVE JAWS FOR AN UNDERGROUND PIPE INSTALLER DEVICE

This is a continuation in part of my co-pending patent application Ser. No. 951,626 filed Oct. 16, 1978.

BACKGROUND OF THE PRESENT INVENTION

It very frequently becomes necessary to install an undergroundpipe between two given points such as the opposed sides of a finished driveway or street, for example. It is a routine procedure to provide an operating trench on one side and a target trench on the opposed side, and an installer device is properly positioned in the operating trench.

A first rod length is manually inserted through drive jaw means of the installer device and engaged thereby to push said first rod length under the street, driveway, etc. by a fluid operated cylinder and piston assembly which may be hydraulically or pneumatically operated and which will be hereinafter referred to as pneumatic. The trailing end of the first rod length is provided with a coupling to receive a second rod length and the pneumatic drive means is actuated to push the second rod length forwardly toward the target trench. A sufficient plurality of rod lengths are similarly attached to preceding rod lengths until the leading tip end of the first rod length emerges into the target trench.

The leading tip end is threadedly provided with a pusher cap which is then removed and replaced with an adapter for attachment to an end of a pipe to be permanently installed under the above surface. For this purpose, the direction of movement is reversed to pull the rods with the pipe attached thereto back through the hole, formed by the rod, until the leading end of the pipe emerges into the operating trench.

The above described operations are quite conventional, however, one particular difficulty is frequently encountered with the use of drive jaws heretofore used to drive the rods through the ground. Large underground rocks are frequently encountered which generally crumble or crack apart to permit passage therethrough of the rods because of the tremendous forces applied thereto by the drive means. However, in extreme cases, the rods which are generally of solid steel will bend between the drive jaws and guide means. Operations must then be suspended until the bent rod is removed and replaced. This is time consuming and also costly as the bent steel rod is then discarded.

Heretofore, the jaws utilized to engage and drive the rods during the hole forming operation are pivoted on transverse axes substantially out of transverse alignment with the longitudinal axis of the coupled hole forming rods. When a very substantial resistance is encountered during the hole forming operation, such as an encounter with a large solid rock, the actual drive forces provided by the fluid drive means will continue to move the jaws forwardly, however, under severe conditions, the off center pivotal arrangement of the drive jaws relative to the rod axis results in a substantial bend in the rod.

The structure of the present invention provides pivot means for the drive jaws with a common axis thereof extending transversely through the longitudinal axis of a rod engaged through the drive jaws. Therefore, when very substantial forces are applied to the drive jaws by a pneumatic drive means, said forces are imparted to the pivot means in a transverse centered relation to the longitudinal axis of the rod in contrast with the substantial off centered relationship between the pivot means and rod axis of prior art devices, and the axially centered forces permit the rods to break through rock obstructions without bending.

Therefore, one of the principal objects of the present invention is to provide an underground pipe installer device with reciprocably operable drive jaw means, including pivot means in a continuous, transverse, intersecting relation to the longitudinal axis of a hole forming rod assembly operably engaged in the drive jaw means for selective movement by appropriate drive means in a forward hole forming direction, and in a return direction for positioning a pipe in the formed holes.

A further object of the invention is to provide bronze slide blade bearing means for the drive jaw means in longitudinal slots in a side wall structure of the pipe installer device.

DESCRIPTION OF A PREFERRED EMBODIMENT

Figure 1:
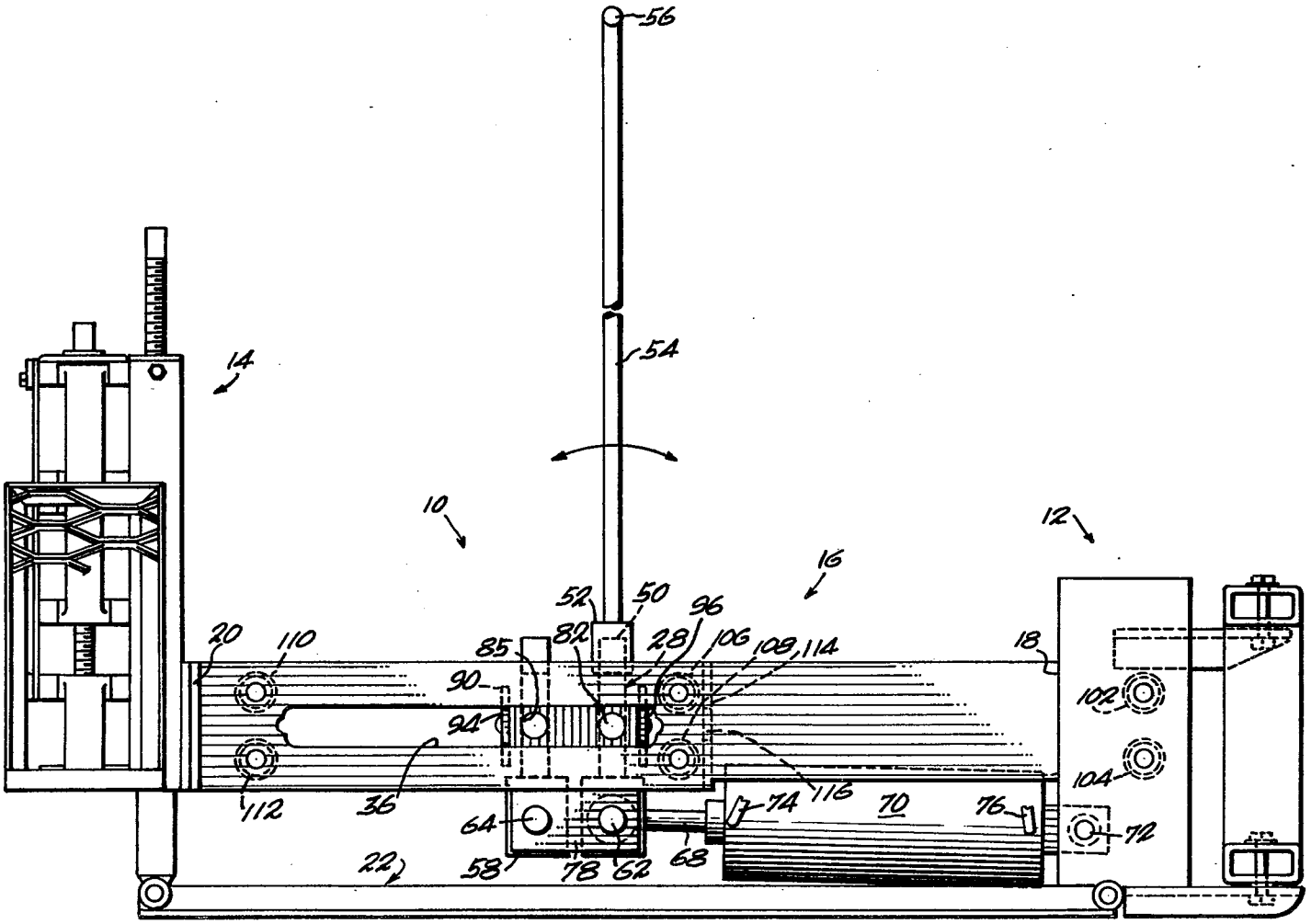
FIG. 1 is a side elevational view of an underground pipe installer device, incorporating the improved drive jaw structure of the present invention.

With reference to the drawings and particularly to FIG. 1, an underground pipe installer including the present invention and indicated generally at 10, also includes forward and rear end portions indicated generally at 12 and 14, forming no part of the present invention, and a central portion 16, connecting between the forward and rear ends as at 18 and 20 above a support base 22.

Figure 2:
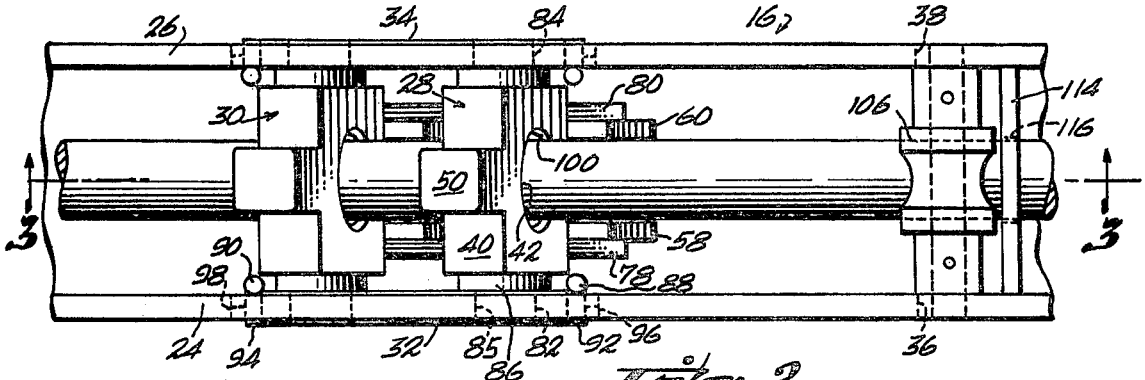
FIG. 2 is a fragmentary top plan view of the device of FIG. 1.

As seen in FIG. 2, the central portion 16 includes a pair of opposed side walls 24, 26 carrying a pair of drive jaws 28, 30 journaled in opposed slide blocks 32, 34, slidably engaged in respective longitudinal slots 36, 38 in side walls 24, 26. Each jaw 28, 30 includes a main body portion 40 with a central hole 42 therein suitably enlarged relative to a hole forming rod assembly comprised of a plurality of rods such as 44, 46 joined by couplings such as 48. A top projection 50 from each jaw 28, 30 is shaped for reception in a socket 52 of an elongated wrench 54 with a top cross bar 56.

A pair of spaced apart, downwardly projecting ears 58, 60 are fixed as by welding to each jaw 28, 30. Transverse pins 62, 64 span the respective pairs of ears 58, 60 and the extended end 66 of a piston drive rod 68 is pivotally engaged on the forward pin 62. The cylinder 70, FIG. 1, of piston rod 68 is pivotally anchored at 72 to the forward end 12 and includes fluid connections 74, 76 at its respective ends for actuation thereof to provide for reciprocating operation of jaws 28, 30, the forward and rear jaws being pivotally connected for simultaneous operation by a pair of side links 78, 80 engaged on pins 62, 64.

The cylinder and piston assembly 68, 70 is preferably pneumatically operated from a compressor source by a remote control reversing valve (not shown) in a conventional manner. Each jaw 28 and 30 is provided with a pair of axially aligned pivot pins 82, 84, the common axes of which extends transversely through the axis of a rod and coupling assembly such as 44, 46 and 48 when engaged in jaws 28, 30 as in FIGS. 2, 3 and 4. Pins 82, 84 of both jaws 28, 30 are pivotally engaged in appropriate apertures 85 in the respective slide blocks 32, 34 which are preferably formed of bronze. Pins 82, 84 are fixed as by welding to the respective sides of jaws 28, 30 and include enlarged annular spacer shoulders 86.

Each slide block 32, 34 is constrained for sliding movement within a slot 36 or 38 by means of a pair of vertical rods 88, 90, fixed as by welding to end plates 92, 94, FIG. 2, bolted as at 96, 98 to the respective ends of blocks 32, 34.

Figure 3:
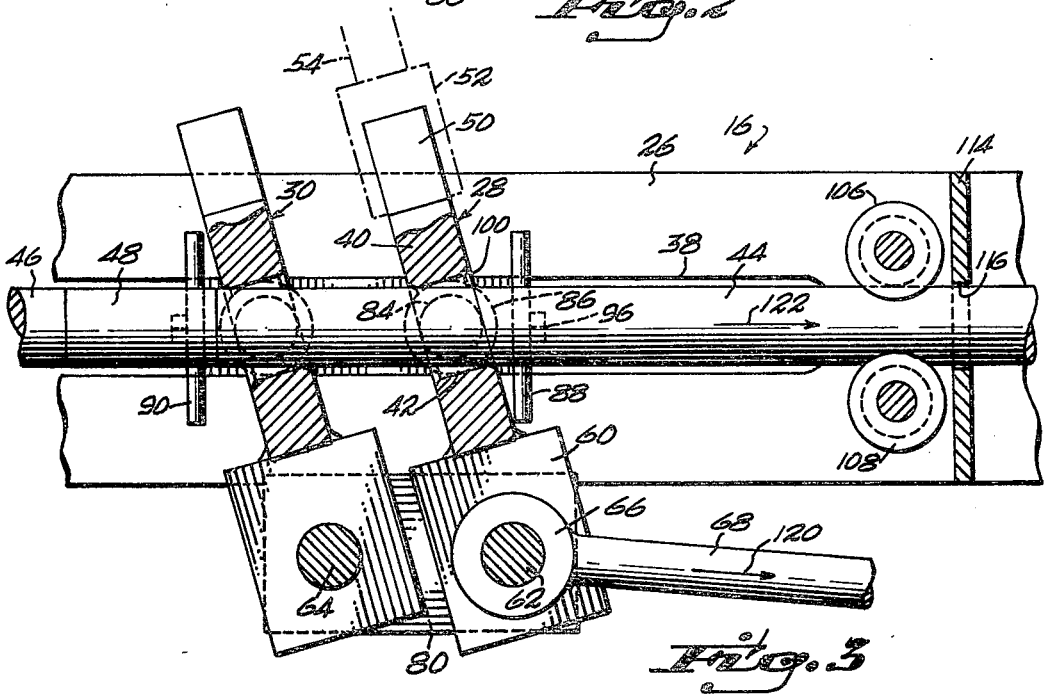
FIG. 3 is a longitudinal vertical sectional view taken along line 3—3 of FIG. 2 illustrating drive jaws thereof in a first position.
Figure 4:
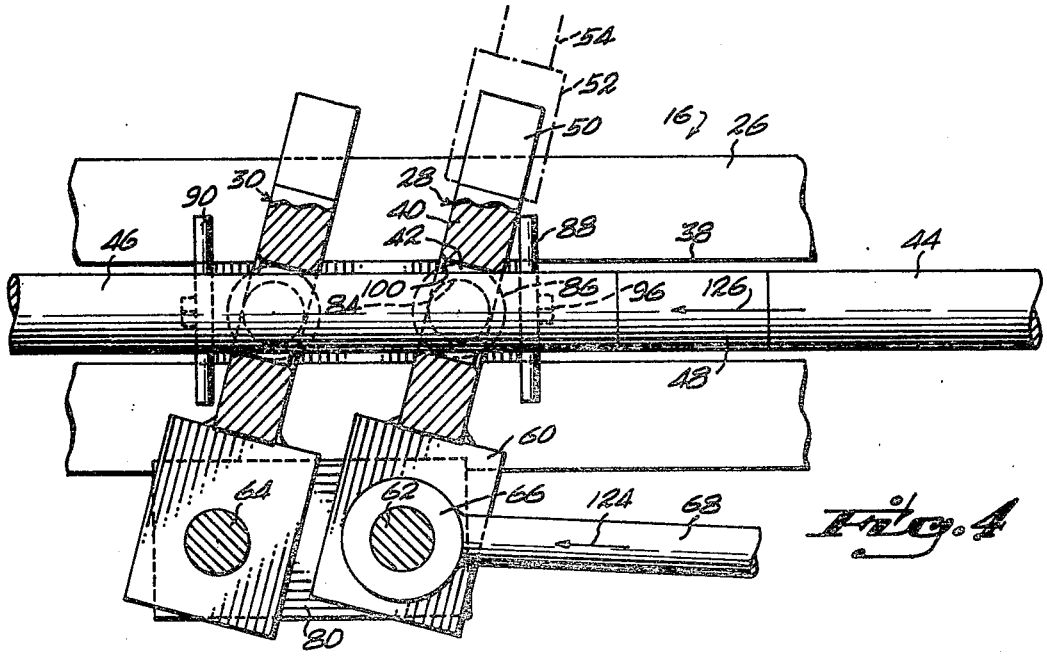
FIG. 4 is a view similar to FIG. 3, illustrating the drive jaws in a second position.

As illustrated in FIGS. 2, 3 and 4, the front and back edges of each jaw hole 42 are preferably chamfered as at 100. In a preferred form the chamfer is approximately 40 degrees. Three pairs of upper and lower guide rollers 102, 104, 106, 108 and 110, 112 are provided for the rods 44, 46, with the central and rear pairs 106, 108 and 110, 112 being positioned outwardly of the opposed ends of the side wall slots 36, 38. The rollers 102, 104 are positioned in the forward end 12. An intermediate cross brace 114 is fixed between the side walls 24, 26 with a passage hole 116 therethrough for the rods such as 44, 46.

In operation, the device 10 is disposed in the operating trench and a first rod is positioned therein as illustrated. The operator manipulates the jaws 28, 30 by means of wrench 54 to position the jaws as in FIG. 3. When the piston 68, is operated in a first direction it is driven in the direction of arrow 120, tightly engaging the jaws on the rod assembly and driving same forwardly in the direction of arrow 122. At the end of each forward stroke the jaws 28, 30 are moved to the neutral position of FIG. 1 and the piston is manually controlled for the return stroke. This operation is continued with subsequent rod lengths being coupled to the rod assembly until the leading end thereof enters the target trench.

The pipe, as above described, is attached to the leading end of the rod assembly and the jaws 28, 30 are manually moved to the position of FIG. 4 by wrench 54 and the operation proceeds with the jaws 28, 30 in driving engagement with the rod assembly on each return stroke to pull the rod assembly and attached pipe backwardly through the hole formed by the rod assembly, see arrows 124, 126, FIG. 4. The jaws 28, 30 are moved to the neutral position of FIG. 1 on each forward stroke.

It should be noted that the underground pipe installer 10 is operable with a single jaw such as 28 under less severe conditions.

I claim:

1. A reversible drive jaw means for use in an underground pipe installer device of the type used to install an underground pipe between two predetermined locations, the drive jaw means being power actuated by a fluid drive means such as a pneumatic piston and cylinder assembly operated by a remote control reversing valve and connected to the drive jaw means to impart reciprocating movement thereto, said drive jaw means comprising at least one drive jaw assembly slidably mounted between a pair of upstanding, spaced apart side walls of the installer device, including a pair of longitudinal slots, respectively in said side walls, a slide block, slidably journaled in each of said slots, said slide jaw assembly including a main transverse jaw plate portion with a round central through hole somewhat enlarged relative to the diameter of a rod, normally passing longitudinally therethrough; a pair of co-axial oppositely disposed journal pins, extending outwardly from opposed side edges of said jaw plate, pivotally journaled respectively in said slide blocks in a transverse axial relation with a longitudinal axis of said rod, whereby said journal pins axes and rod axis lie in a substantially common plane in a generally right angular intersecting relation.

2. The drive jaw means as defined in claim 1 including manual operating means whereby said jaw plate is selectively angled in a first direction to engage the rod passing therethrough in a manner so as to drive some in a first direction upon proper manipulation of the reversing valve, or angled in a second direction to engage and drive the rod in a reverse direction.

3. The drive jaw means as defined in claim 2 including a second drive jaw assembly, disposed in a predetermined spaced relation to said one jaw assembly to coact therewith in driving the rod in said forward and reverse directions.

4. The drive jaw means as defined in claim 3 including a pair of pivotal links connecting between said two jaw assemblies.

5. The drive jaw means as defined in claim 1 including front and back vertically extended guide means fixed to each of said slide blocks to maintain same in a sliding relation within their respective said slots.

6. The drive jaw means as defined in claim 2 wherein said manual control means comprises a top extension from said jaw plate, sized and configurated for reception within a socket of an elongated wrench.

7. The drive jaw means as defined in claim 3 wherein front and back peripheral edges of each of said round through holes is chamfered.

8. The drive means as defined in claim 1 wherein said slide blocks are formed of bronze.

9. The drive means as defined in claim 1 wherein an extended end of a piston rod from the piston is pivotally connected to a transverse rod carried between a pair of downwardly extended, spaced apart ears fixed to a bottom edge of said jaw plate.

* * * * *